US005687575A

United States Patent [19]

Keville

[11] Patent Number: 5,687,575

[45] Date of Patent: Nov. 18, 1997

[54] MINIATURE THERMO-ELECTRIC COOLED CRYOGENIC PUMP

[75] Inventor: Robert F. Keville, Valley Springs, Calif.

[73] Assignee: Regents of the University of California, Oakland, Calif.

[21] Appl. No.: 639,669

[22] Filed: Apr. 29, 1996

[51] Int. Cl.[6] ..... B01D 8/00

[52] U.S. Cl. ..... 62/55.5; 62/3.2; 165/80.4

[58] Field of Search ..... 62/3.2, 55.5; 165/80.4

[56] References Cited

U.S. PATENT DOCUMENTS

| | | | |
|---|---|---|---|
| 3,423,947 | 1/1969 | Moriya | 62/55.5 |
| 3,719,052 | 3/1973 | White | 62/55.5 |
| 4,290,273 | 9/1981 | Meckler | 63/3.2 |

*Primary Examiner*—Ronald C. Capossela

*Attorney, Agent, or Firm*—L. E. Carnahan; Henry P. Sartorio

[57] ABSTRACT

A miniature thermo-electric cooled cryogenic pump for removing residual water molecules from an inlet sample prior to sample analysis in a mass spectroscopy system, such as ion cyclotron resonance (ICR) mass spectroscopy. The cryogenic pump is a battery operated, low power (<1.6 watts) pump with a $\Delta T=100°$ C. characteristic. The pump operates under vacuum pressures of $5\times10^{-4}$ Torr to ultra high vacuum (UHV) conditions in the range of $1\times10^{-7}$ to $3\times10^{-9}$ Torr and will typically remove partial pressure, $2\times10^{-7}$ Torr, residual water vapor. The cryogenic pump basically consists of an inlet flange piece, a copper heat sink with a square internal bore, four two tier Peltier (TEC) chips, a copper low temperature square cross sectional tubulation, an electronic receptacle, and an exit flange piece, with the low temperature tubulation being retained in the heat sink at a bias angle of 5°, and with the TECs being positioned in parallel to each other with a positive potential being applied to the top tier thereof.

20 Claims, 2 Drawing Sheets

MINIATURE THERMO-ELECTRIC COOLED CRYOGENIC PUMP

The United States Government has rights in this invention pursuant to Contract No. W-7405-ENG48 between the United States Department of Energy and the University of California for the operation of Lawrence Livermore National Laboratory.

BACKGROUND OF THE INVENTION

The present invention relates to cryogenic pumps, particularly to miniature cryogenic pump, and more particularly to a miniature thermoelectric cooled cryogenic pump for removing residual water molecules from a sample prior to analysis of the sample.

Mass spectroscopy involves the analysis of various types of samples. There are certain aspects of mass spectroscopy, such as ion cyclotron resonance (ICR) mass spectroscopy (MS) which require that residual water molecules be removed from the inlet sample prior to sample analysis, especially if the system is under ion pumping conditions. During the development of the miniature ion cyclotron resonance mass spectrometer, it became apparent that the residual water vapor problem was even more acute and such would greatly detract from the analysis ability of the instrument. Water vapor can contribute up to 10% of the total partial pressure in a vacuum system.

The ionizing of this water vapor interferes with the detection of other requested excite spectra. Even with the utilization of known techniques, such as Stored Wave Inverse Fourier Transform (SWIFT) or quadrupolar axialization, one cannot remove the majority of residual vapor in the vacuum system. Current state of the art cryogenic pumps are designed to pump a variety of gaseous matter at temperatures near 77° Kelvin. These prior cryogenic pumps involve large compressor based units which require high pressure helium and typically 230V @ 20A to operate correctly. Typical pump inlet flanging is from 4 to 12 inches. All of the prior known cryogenic pumps require rough pumping prior to operation. Thus, with the efforts to miniaturize mass spectrometer systems, a need arose for a small, low-power cryogenic pump capable of removing the undesired residual water vapor from samples prior to analysis thereof. This need is satisfied by the present invention which pumps one specific molecule, $H_2O$, is battery operated, is mounted with an ultra high vacuum flange of 1.33 inches diameter, and is smaller by a factor of ten than the nearest sized cryogenic pump. It is sized for operation on the latest state of the art ICR Mass Spectrometers.

SUMMARY OF THE INVENTION

It is an object of the present invention to remove residual water vapor from a sample prior to analysis of the sample via mass spectroscopy.

A further object of the invention is to provide a miniature cryogenic pump for removing water molecules.

A further object of the invention is to provide a miniature cryogenic pump which is battery operated, will operate under a wide range of vacuum conditions, and is at least smaller by a factor of 10 than existing cryogenic pumps.

A further object of the invention is to provide a miniature, low power, cryogenic pump capable of removing residual water vapor for ICR mass spectroscopy.

Another object of the invention is to provide a miniature thermo-electric cooled cryogenic pump.

Another object of the invention is to provide a battery operated, low power, miniature cryogenic pump with a $\Delta T=100°$ C. characteristic, capable of operating under vacuum pressures of $5\times10^{-4}$ Torr to ultra high ($3\times10^{-9}$ Torr) vacuum conditions, and capable of removing partial pressure ($2\times10^{-7}$ Torr), residual water vapor.

Other objects and advantages of the invention will become apparent from the following description and accompanying drawings. The invention is a miniature thermoelectric cooled cryogenic pump for removing one specific molecule, $H_2O$, from a sample for analysis in a mass spectrometer. The cryogenic pump is battery operated, has low power usage (<1.6 watts) with a $\Delta T=100°$ C. characteristic, operates under vacuum pressures of $5\times10^{-4}$ Torr to $3\times10^{-9}$ Torr, and capable of removing partial pressure ($2\times10^{-7}$ Torr), residual water vapor. The cryogenic pump is particularly adapted for use in mass spectroscopy, particularly ICR mass spectroscopy, chromatographic applications, and gas bleed systems. In addition the pump has application wherever it requires removal of residual water vapor in either low flow or static conditions, such as deposition by sputtering, plasma etch and ion beam etch. Basically, the miniature thermo-electric cooled cryogenic pump comprises an inlet flange piece, a heat sink, four two tier Peltier (TEC) chips, a low temperature tubulation panel, an electronic receptacle, and an exit flange piece. An embodiment of the pump has a length of 3.005 inches with an external diameter of 1.330 inches and inlet/exit flanges of 1.33 inch diameter. The low temperature tubulation panel of a hollow, square cross-section in one embodiment, is retained within the heat sink at a selected bias angle, such as 5°, to increase the surface area of contact with sample material passing either through or around, such that cooling is on the inside diameter (ID) as well as the outside diameter (OD). The two tier TECs are bonded to the heat sink and to the low temperature tubulation, and have for example a 100° C. temperature differential. Thus, as residual water vapor in a sample passes through or around the low temperature tubulation panel the water vapor is frozen on the surface of the tubulation, while other gases in the sample pass into the analyzing region where they are excited and detected. When the cryogenic pump panel is in saturation the TECs are turned off and the outgassing is allowed to migrate to the system vacuum pump.

BRIEF DESCRIPTION OF THE DRAWINGS

The accompanying drawings, which are incorporated into and form a part of the disclosure, illustrate an embodiment of the invention and, together with the description, serve to explain the principles of the invention.

DETAILED DESCRIPTION OF THE INVENTION

Figure 1:
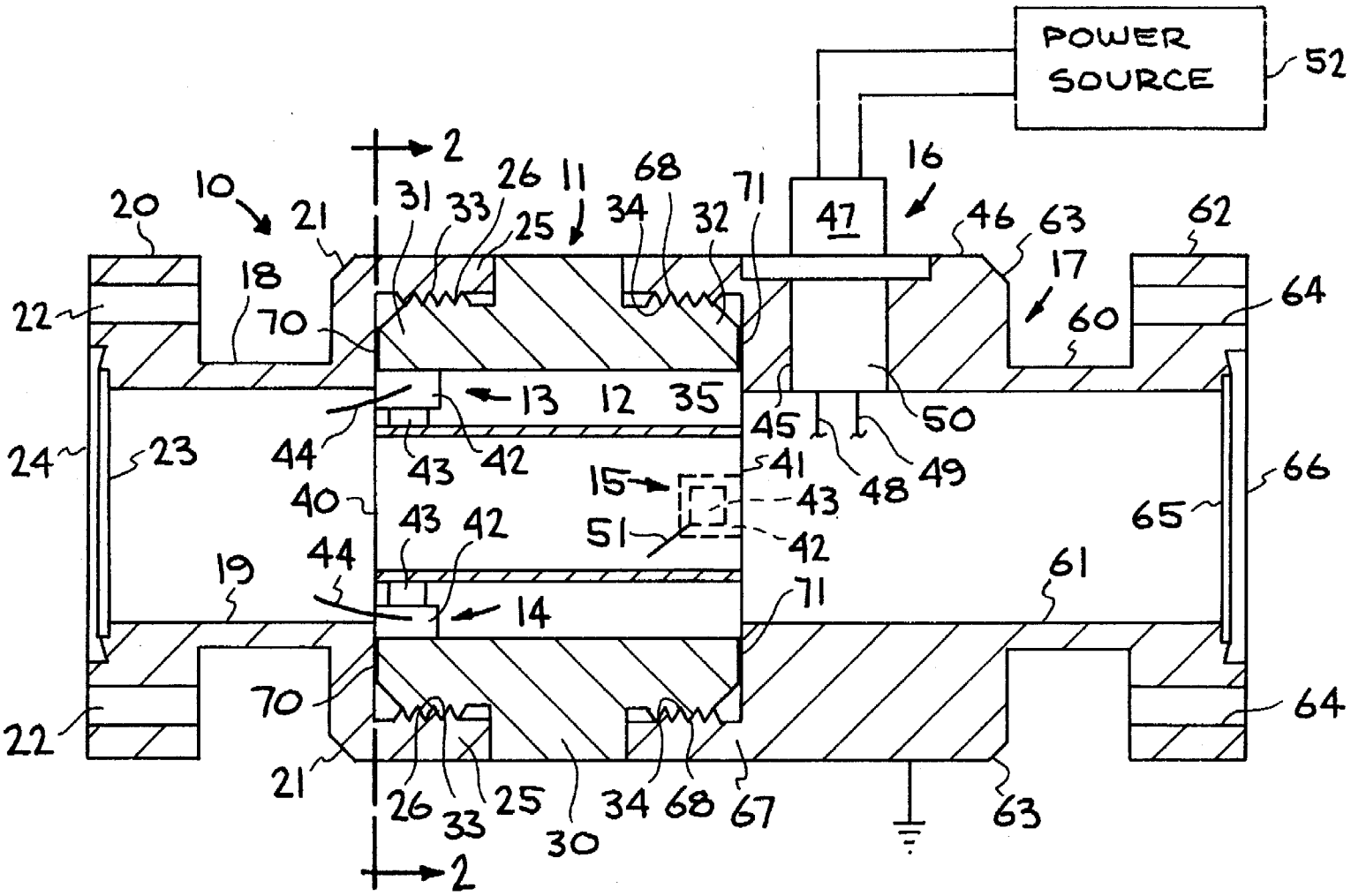
FIG. 1 is a partial cross-sectional view of an embodiment of a miniature thermo-electric cooled cryogenic pump.

The present invention is a miniature thermo-electric cooled cryogenic pump, which is battery operated, uses low power (<1.6 watts), capable of operation under vacuum pressures of $5\times10^{-4}$ Torr to $3\times10^{-9}$ Torr, and with a $\Delta T=100°$ C. characteristic. The cryogenic pump will remove partial pressure, $2\times10^{-7}$ Torr, residual water vapor. An embodiment of the pump is designed for one specific molecule, $H_2O$, uses small (1.33 inch diameter) mounting flanges, has a length of 3.005 inches and external diameter of 1.330 inches, is smaller by a factor of ten than any known cryogenic pump, and is sized for operation on an ion cyclotron resonance (ICR) mass spectrometer.

The cryogenic pump of the present invention basically consists of: 1) an inlet flange piece, 2) a heat sink, 3) a plurality of thermo-electric devices such as two tier Peltier thermo-electric chips (TEC), 4) a low temperature tubulation or panel, 5) an electronic receptacle, and 6) an exit flange piece. In the illustrated embodiment, the heat sink is constructed of copper and has a square internal bore; there are two sets of TECs located at opposite ends of the low temperature panel and spaced 180° apart with each set rotated 90° from the other, and the low temperature tubulation or panel is of a hollow square cross-section constructed of copper. The inlet and exit flange pieces include 1.33 inch diameter conflat design flanges for ultra high vacuum (UHV) applications. Conflat design flanges are well known in the art, and the two tier Peltier TECs are commercially available, being manufactured by Marlowe Industries, Dallas, Tex. The copper low temperature tubulation or panel is held within the confines of the square configured internal bore within the heat sink at a bias angle, 5° in the illustrated embodiment. By positioning the panel at an angle with respect to the normal flow path of sample material passing therethrough and there around, a larger surface area of contact is provided for the water vapor in the sample material. The TECs are held in place with, for example, silver conductive epoxy applied to their base or hot side and in contact with the heat sink, and the low temperature tubulation or panel is attached to the cold side of the TECs with the same epoxy. In both cases the epoxy has a maximum thickness of 0.001 inch. The total pump length is 3.005 inches with an external diameter of 1.330 inches, the same diameter as the inlet and exit flanges. The inlet and exit flange pieces are secured to the heat sink with 1–24 threads and sealed against atmosphere with a suitable UHV 2-part epoxy, such as Torr Seal made by Varian and Associates. The electronic receptacle includes an electrical feed through of a conventional two pin design with a shield being ground. Such a feed through is well known in the art and further description or illustration thereof is deemed unnecessary. The TECs are aligned electrically in parallel to each other with a positive potential being applied to the right side lead as viewed from the top. Since electrical interconnection of the TECs is well known, illustration or further description thereof is deemed unnecessary. The two tier TECs in this embodiment have a 100° C. temperature differential between the hot side and the cold side, and are electrically grounded via the shield of the electrical feed through and the exit flange piece as indicated by the ground symbol.

Referring now to the drawings, the illustrated embodiment comprises an inlet flange piece 10, a heat sink 11, a low temperature tubulation or cryogenic panel 12, a plurality of thermo-electric devices such as thermo-electric chips (TECs), 13, 14, 15, and 16 an electronic receptacle 16', and an exit flange piece 17, the electronic receptacle 16' being located in exit flange piece 17, and TECs 13–16 being secured between heat sink 11 and panel 12.

Inlet flange piece 10 includes a body 18 having an opening 19 and a pair of protruding end sections 20 and 21. End section 20 includes a plurality of openings 22 through which bolts or screws are adapted to extend for securing the inlet flange piece to an inlet valve, conduit, tube, or other point of use. End section 20 also includes a pair of counterbores 23 and 24 of different diameter and configuration in which a conventional conflat seal, not shown, is positioned. End section 21 includes a flange-like portion 25 having an internally threaded section indicated at 26.

Heat sink 11, constructed of copper in this embodiment, comprises a body section 30 having reduced diameter end sections 31 and 32 having external threads 33 and 34, respectively and a central opening or bore 35. The opening 35 in this embodiment is of a square cross-section but may be of a different cross-sectional configuration. The threads 33 of end section 31 cooperate with threaded section 26 of flange-like portion 25 of end section 21.

The low temperature tubulation or cryogenic panel 12 is, in this embodiment, constructed of copper and is hollow and of a square cross-section. For example, each panel 12 may be 0.75 inch in length, 0.5 inch in width, and 0.010 inch thick. The panel 12 is held within the confines of the square configured internal bore 35 of heat sink 11 at a bias angle of 5°, but this angle may vary from 3° to 10°.

Figure 2:
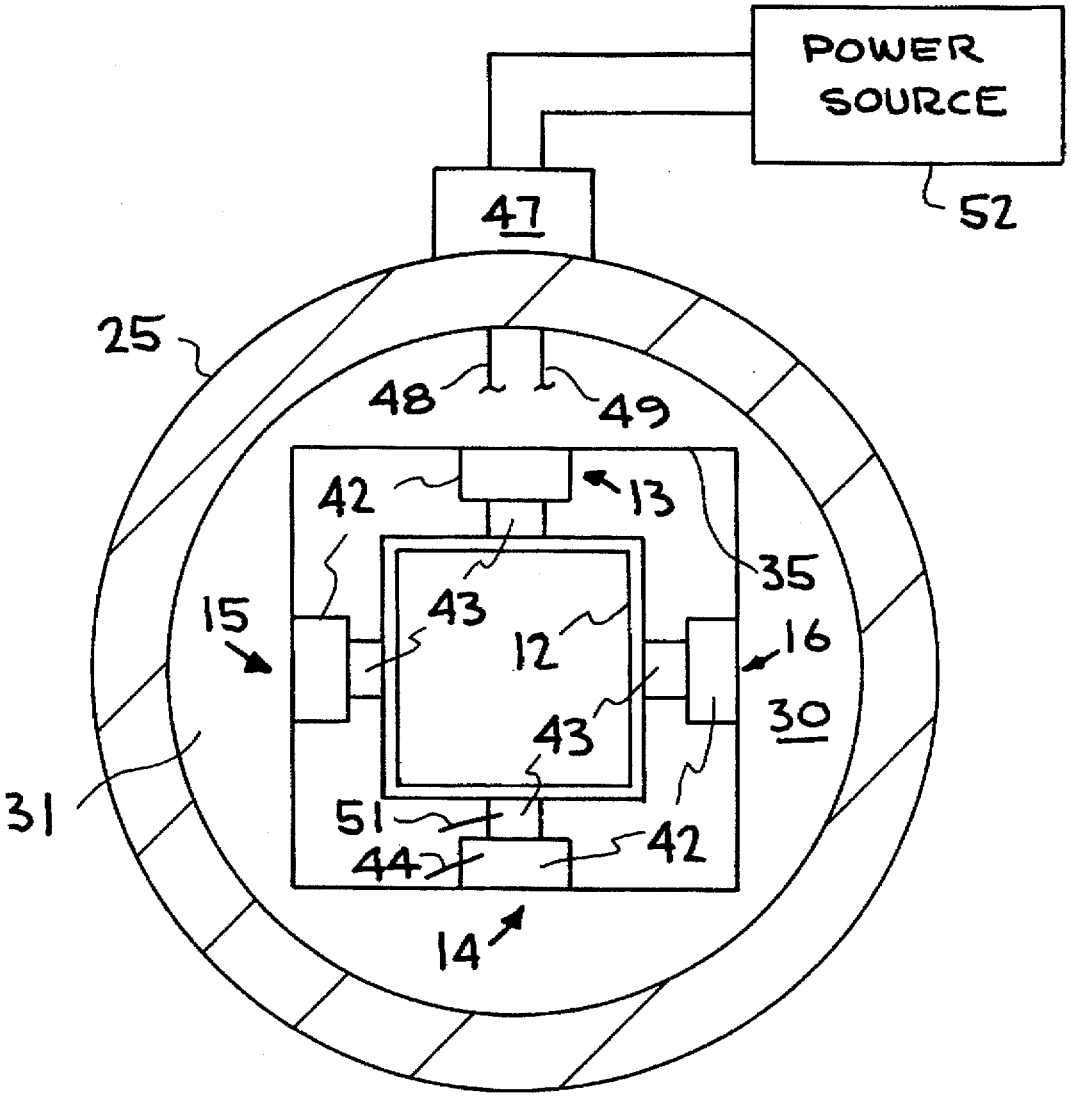
FIG. 2 is a view of the FIG. 1 pump illustrating the square cross-section configuration of the cryogenic panel thereof.

The two tier TECs 13, 14, and 15 shown in FIG. 1 constitute, in this embodiment, three (3) of the four (4) TECs utilized as seen in FIG. 2. A first pair of TECs 13 and 14 are spaced 180° and located at end 40 of panel 12, while TEC 15 and TEC 16, are spaced 180° and located at end 41 of panel 12. The TEC pairs are rotated 90° with respect to each other such that a PEC is positioned at each 90° segment of panel 12 so as to provide uniform cooling of the panel 12. Each TEC includes a hot side 42 secured to heat sink 11 and a cold side 43 secured to panel 12. The TECs are bonded to heat sink 11 and panel 12 via a 0.001 inch thick silver conductive epoxy, for example. By way of example, the TECs in this embodiment are two tier Peltier thermo-electric chips, manufactured by Marlowe Industries. As pointed out above the TECs are aligned and electrically connected in parallel to each other with a positive potential being applied to a lead indicated at 44.

The electronic receptacle 16' is located in an opening in exit flange piece 17 of different diameters as indicated at 45 and 46 in which is positioned an electrical feed through 47 of a two pin design (pins 48 & 49) with a shield 50, the shield 50 being a ground. The positive lead 48 of feed through 47 is adapted to be connected to positive lead 44 of TECs 13–15, with the negative lead 49 being connected to negative leads 51 located on the TECs. The electrical feed through 47 is connected to a battery or other power supply, indicated at 52.

The exit flange piece 17 includes a body 60 having an opening 61 and a pair of protruding end sections 62 and 63. End section 62 includes a plurality of openings 64 through which bolts or screws are adapted to extend for securing the exit flange piece to a point of use. End section 62 also includes a pair of countersinks 65 and 66 of different diameter and configuration in which a conventional conflat seal, not shown, is positioned. End section 63 includes a flange-like portion 67 having an internally threaded section indicated at 68 which cooperates with threads 34 of heat sink 11 for securing the exit flange piece 17 to heat sink 11. End section 63 also includes the openings 45 and 46 for electronic receptacle 16' and serves as an electrical ground as indicated by the ground symbol.

As pointed out above the inlet and exit flange pieces 10 and 17 are of a 1.33 inch diameter using a conflat design for UHV applications. The total length of components 10, 11, and 17 is 3.005 inches, each with an external diameter of 1.330 inches. The inlet and exit flange pieces are secured to the heat sink via the respective threaded sections 26/33 and 34/68 which in this embodiment are 1–24 type threads. In addition the flange pieces 10 and 17 are sealed against atmospheric leaks to heat sink 11 as indicated at 70 and 71, using a suitable sealant such as a UHV two-part epoxy, such as Torr Seal. While the heat sink 11 and low temperature tubulation 12 are constructed of copper, they may also be constructed of aluminum, gold, or silver.

A typical operating scenario of the miniature thermo-electric cryogenic pump with the TECs turned on is: A gas inlet valve opens to an analyzer, a gas sample enters the system and passes through or around the low temperature tubulation or cryogenic panel where water vapor in the sample is frozen to the surface of the panel. Other gases of the sample which make up the remainder of the partial pressure pass into the analyzing region where they are excited and detected. All of the remaining gases are eventually removed by the system vacuum pump. When the cryogenic panel of the pump is in saturation the TECs are turned off and the outgassing is allowed to migrate to the system vacuum pump. Initiate tests indicate it takes several months of continuous operation to saturate the cryogenic panel. Currently the operation of a prototype of the cryogenic pump has been tested in static condition for an extended period of 200 hours with no degradation of system pressure. Typical pressure rises with a base pressure of $3\times10^{-8}$ Torr to $2\times10^{-6}$ Torr with the cryogenic pump power off and measured with a calibrated Bayard-Alpert vacuum gauge. The prototype cryogenic pump has been operated for several hundred inlet pulses with no degradation of the total system pressure of $5\times10^{-7}$ Torr. The initial testing established that the cryogenic pump will typically remove partial pressure ($2\times10^{-7}$ torr) residual water vapor. The cryogenic pump prototype was designed to operate under vacuum pressures of $5\times10^{-4}$ torr to ultra high vacuum (UHV) conditions, in the range of $1\times10^{-7}$ to $3\times10^{-9}$ Torr. Tests established that the cryogenic pump can be battery operated, using low power (<1.6 watts) with a $\Delta T=100°$ C. differential produced by the two tier Peltier TECs.

It has thus been shown that the miniature thermo-electric cooled cryogenic pump of this invention effectively removes one specific molecule, $H_2O$ from a sample gas to be analyzed, for example, in a miniature ion cyclotron resonance (ICR) mass spectrometer. Thus, the cryogenic pump of this invention can be utilized in any application which requires removal of residual water vapor in either low flow or static conditions.

While a specific embodiment, materials, parameters, etc., have been set forth they exemplify and explain the principles of the invention, such are not intended to be limiting. Modifications and changes may become apparent to those skilled in the art and it is intended that the invention be limited only by the scope of the appended claims.

The invention claimed is:

1. A cryogenic pump, including:

an inlet flange piece, an outlet flange piece, a heat sink operatively connected intermediate said inlet and outlet flange pieces and having an opening therein, a low temperature tubulation positioned within said opening of said heat sink, and a plurality of thermo-electric chips positioning within said opening of said heat sink and radially secured intermediate said low temperature tubulation and said heat sink.

2. The cryogenic pump of claim 1, wherein said opening in said heat sink is of a square cross-section, and wherein said low temperature tubulation has at least a square outer surface.

3. The cryogenic pump of claim 1, additionally including an electronic receptacle in one of said inlet and exit flange pieces.

4. The cryogenic pump of claim 1, wherein said plurality of thermo-electric chips are of a two tier type.

5. The cryogenic pump of claim 4 wherein said two tier type thermo-electric chips have a hot side connected to said heat sink and a cold side connected to said low temperature tubulation.

6. The cryogenic pump of claim 1, wherein said plurality of thermo-electric chips are located in sets spaced from one another, said chips of each set being spaced apart, and each chip being in a non-axially aligned position with respect to said other chips.

7. The cryogenic pump of claim 1, wherein said plurality of thermo-electric chips are secured to said heat sink and to said low temperature tubulation by a conductive epoxy.

8. The cryogenic pump of claim 1, wherein said plurality of thermo-electric chips comprise four chips, two of said four chips being located at opposite ends of said low temperature tubulation, and each chip is spaced from another chip so as to be in a non-axially aligned position.

9. The cryogenic pump of claim 1, wherein each of said inlet and exit flange pieces has a threaded section, wherein said heat sink has a threaded section adjacent each end thereof, and wherein said inlet and exit flange pieces are connected to said heat sink via said threaded sections thereof.

10. The cryogenic pump of claim 9, additionally including a sealant between said heat sink and each of said inlet and exit flange pieces.

11. The cryogenic pump of claim 1, wherein said low temperature tubulation is positioned within said heat sink at a bias angle of 3° to 10°.

12. The cryogenic pump of claim 1, wherein each of said inlet and exit flange pieces include an end section constructed to retain a conflat seal arrangement.

13. The cryogenic pump of claim 1, additionally including an electrical feed through operatively mounted in one of said inlet and exit flange pieces, said electrical feed through being operatively connected to each of said plurality of thermo-electric chips and to a power source located externally of said flange pieces.

14. The cryogenic pump of claim 1, having a length of about 3 inches and external diameter of about 1.3 inches, wherein said opening in said heat sink is of a square cross-section, wherein said low temperature tubulation is of a hollow square cross-section, wherein said heat sink and said tubulation are constructed of material selected from the group consisting of copper, aluminum, gold, and silver, and wherein said thermo-electric chips are two tier Peltier thermal-electric chips.

15. In a mass spectrometer system, the improvement comprising:

means for removing residual water vapor in a sample to be analyzed in said mass spectrometer system, said means including a cryogenic panel located within a heat sink said cryogenic panel being connected to said heat sink by a plurality of radially extending two tier thermo-electric chips positioned within said heat sink.

16. The improvement of claim 15, wherein said thermo-electric chips are battery operated.

17. The improvement of claim 15, wherein said cryogenic panel and said heat sink are constructed of material selected from the group consisting of copper, aluminum, gold, and silver.

18. A device for removing residual water vapor, including:

a heat sink having an opening thereon, a cryogenic panel positioned within said opening of said heat sink at a bias angle of about 3°–10°, a plurality of thermo-electric devices radially positioned between and connected to said heat sink and to said cryogenic panel, and means for activating said thermo-electric devices for cooling said cryogenic panel, wherein residual water vapor passing across a surface of said cryogenic panel is frozen thereon.

19. The device of claim 18, wherein said thermo-electric devices each comprise a two tier thermo-electric chip.

20. The device of claim 18, wherein said thermo-electric devices are battery operated, have a power usage of <1.6 watts with a $\Delta T=100°$ C. characteristic, operate under vacuum pressures of $5\times10^{-4}$ Torr to $3\times10^{-9}$ Torr, and are capable of removing partial pressure ($2\times10^{-7}$ Torr) residual water vapor.

* * * * *